US007281284B2

(12) United States Patent
Sims, Jr.

(10) Patent No.: US 7,281,284 B2
(45) Date of Patent: Oct. 16, 2007

(54) VARIABLE MOTION ROCKING BED

(76) Inventor: Dewey M. Sims, Jr., 38744 Laurenwood St., Wayne, MI (US) 48184

( * ) Notice: Subject to any disclaimer, the term of this patent is extended or adjusted under 35 U.S.C. 154(b) by 43 days.

(21) Appl. No.: 11/263,217

(22) Filed: Oct. 31, 2005

(65) Prior Publication Data

US 2007/0094792 A1 May 3, 2007

(51) Int. Cl.
*A61G 7/008* (2006.01)

(52) U.S. Cl. ..... 5/607; 5/609; 5/108; 5/109

(58) Field of Classification Search ..... 5/607–611, 5/108, 109, 101
See application file for complete search history.

(56) References Cited

U.S. PATENT DOCUMENTS

| | | | | | |
|---|---|---|---|---|---|
| 417,812 | A | * | 12/1889 | Cobleigh | 5/103 |
| 1,500,009 | A | | 7/1924 | Smaldone | |
| 1,727,635 | A | * | 9/1929 | Crane | 5/109 |
| 1,795,246 | A | | 3/1931 | Brown | |
| 2,243,013 | A | | 5/1941 | Morey et al. | |
| 2,311,542 | A | | 2/1943 | Holme | |
| 2,478,445 | A | | 8/1949 | Yurkovich | |
| 2,570,676 | A | | 10/1951 | Henderson | |
| 2,785,417 | A | * | 3/1957 | Burston | 5/610 |
| 2,841,802 | A | | 7/1958 | Leverett | |
| 2,845,635 | A | | 8/1958 | Eyer | |
| 2,884,651 | A | * | 5/1959 | Garey | 5/109 |
| 2,941,526 | A | | 6/1960 | Mott | |
| 2,972,152 | A | | 2/1961 | Vincent | |
| 3,056,145 | A | | 10/1962 | McKinley et al. | |
| 3,149,229 | A | * | 9/1964 | Morel | 5/601 |
| 3,378,859 | A | | 4/1968 | Parker | |
| 3,434,165 | A | | 3/1969 | Keane | |
| 3,532,089 | A | | 10/1970 | Arntzenius | |
| 3,585,989 | A | | 6/1971 | Little | |
| 3,609,357 | A | * | 9/1971 | Jones | 378/209 |
| 3,739,406 | A | | 6/1973 | Koetter | |
| 3,748,666 | A | | 7/1973 | Seng | |
| 3,826,250 | A | | 7/1974 | Adams | |
| 4,028,753 | A | | 6/1977 | Rios | |
| 4,061,137 | A | | 12/1977 | Sandt | |
| 4,071,916 | A | | 2/1978 | Nelson | |
| 4,114,209 | A | | 9/1978 | Sandlin | |

(Continued)

*Primary Examiner*—Robert G. Santos
(74) *Attorney, Agent, or Firm*—Mastrogiacomo PLLC; Patrick Mastrogiacomo, Jr.

(57) ABSTRACT

A variable motion rocking bed is provided that includes a first support structure including a first threaded rod having a first section threaded in a first direction and a second section threaded in a second direction, a second support structure including a second threaded rod having a first section threaded in a first direction and a second section threaded in a second direction, and a frame, the frame capable of being in a rocking motion with respect to the first support structure and the second support structure. The rocking bed further includes a first pair of linkage assemblies secured between the first support structure and the frame, and a second pair of linkage assemblies secured between the second support structure and the frame. The position of the first pair of linkage assemblies may be adjusted with respect to the first support structure and the position of the second pair of linkage assemblies may be adjusted with respect to the second support structure to change the shape of the rocking motion of the frame relative to the first support structure and the second support structure.

20 Claims, 8 Drawing Sheets

U.S. PATENT DOCUMENTS

| | | | | |
|---|---|---|---|---|
| 4,133,305 | A | 1/1979 | Steuer | |
| 4,175,550 | A | 11/1979 | Leininger et al. | |
| 4,194,499 | A | 3/1980 | Donnelly, Jr. | |
| 4,277,857 | A | 7/1981 | Svehaug | |
| 4,356,577 | A | 11/1982 | Taylor et al. | |
| 4,357,722 | A | 11/1982 | Thompson | |
| 4,441,220 | A | 4/1984 | Peterson | |
| 4,483,327 | A | 11/1984 | Graham et al. | |
| 4,586,492 | A | 5/1986 | Manahan | |
| 4,658,451 | A | 4/1987 | Taniguchi | |
| 4,672,952 | A | 6/1987 | Vrzalik | |
| 4,752,980 | A | 6/1988 | Nafte | |
| 4,866,796 | A | 9/1989 | Robinson et al. | |
| 4,953,244 | A | 9/1990 | Koerber, Sr. et al. | |
| 5,042,097 | A | 8/1991 | Fuchs | |
| 5,086,769 | A | 2/1992 | Vianello | |
| 5,103,511 | A | 4/1992 | Sequin | |
| 5,131,103 | A | 7/1992 | Thomas et al. | |
| 5,186,424 | A | 2/1993 | Shultz et al. | |
| 5,228,155 | A | 7/1993 | Shultz et al. | |
| 5,301,661 | A | 4/1994 | Lloyd | |
| 5,520,614 | A | 5/1996 | McNamara et al. | |
| 5,553,337 | A | 9/1996 | Lin | |
| 5,711,045 | A | 1/1998 | Caster et al. | |
| 5,713,832 | A | 2/1998 | Jain | |
| 5,752,925 | A | 5/1998 | Beaupre et al. | |
| 5,802,634 | A * | 9/1998 | Onishi et al. | 5/93.2 |
| 5,993,401 | A | 11/1999 | Inbe et al. | |
| 6,263,526 | B1 | 7/2001 | Tu | |
| 6,385,801 | B1 | 5/2002 | Watanabe et al. | |
| 6,620,117 | B1 | 9/2003 | Johnson et al. | |
| 6,695,799 | B2 | 2/2004 | Kitadou et al. | |
| 6,971,127 | B2 * | 12/2005 | Richards | 5/108 |
| 2002/0100116 | A1 * | 8/2002 | Richards | 5/108 |
| 2007/0094792 | A1 * | 5/2007 | Sims, Jr. | 5/109 |

* cited by examiner

VARIABLE MOTION ROCKING BED

CROSS REFERENCE TO RELATED APPLICATIONS

Not Applicable

STATEMENT REGARDING FEDERALLY SPONSORED RESEARCH OR DEVELOPMENT

Not Applicable

INCORPORATION-BY-REFERENCE OF MATERIAL SUBMITTED ON COMPACT DISC

Not Applicable

BACKGROUND OF THE INVENTION

1. Field of the Invention

The present invention relates generally to a rocking bed and, more particularly, to an adjustable pivot linkage used to vary the displacement and type of motion of a rocking bed.

2. Background Art

The vast majority of people spend their sleeping hours in the prone position on a bed. It is well known that a person, while sleeping, shifts the position of their body frequently every night. While asleep, a normal healthy adult changes the position of his body every eleven and one half minutes or about 42 times during an eight hour sleep cycle. The reason for the constant position change is that most people are not able to rest comfortably due to the relatively high contact pressures between areas on their body and the bed. These pressures are the result of the bed exerting a force equal to the force exerted by the body at any particular point. People move frequently, if they can, to alleviate the pressure on their bodies. Those who are not able to move their body, such as individuals confined to their beds in a hospital, may be subject to bed sores. These are well known facts in the bed making industry that has lead to some advancements in the materials used in manufacturing beds and mattresses, yet the problems associated with constantly changing positions (such as an inadequate amount of sleep, restlessness, insomnia, etc.) still exists for the masses.

Another solution for aiding individuals in the pursuit of a restful nights sleep or for those who are confined to their beds has been the introduction of the rocking bed. A rocking bed automatically varies the amount of pressure and the location of the pressure on the body. The periodic rocking motion on a resting body increases relaxation and in the case of a person confined to their bed may help reduce the number and severity of bed sores caused by the constant contact and pressure of a body part on the bed. A rocking bed may also aid those people who are dependant on sleep inducing medication to achieve a full night's sleep without the aid of medication.

While rocking beds are well known in the art, many only provide for a single type of rocking motion. An example of a rocking motion that is often times replicated on a rocking bed is that of a boat gently swaying at sea. This rocking motion of a boat at sea is most notably replicated on the crib of an infant. The soothing and gentleness of the side to side motion helps to ease a restless infant into sleep. The rocking motion on a crib may be achieved by curving or arching the bottom legs of the crib that contact the floor such that the upper portion of the crib may be swayed from side to side on the curved bottom legs.

Many of the adult size rocking beds have been designed with the same concept in mind. However, rather than curving the bottom legs of the bed that contact the floor, other less cumbersome means of rocking beds have been developed. For example, many rocking beds that are well known in the art employ some type of linkage that connects from the stationary bed frame to the moveable mattress frame. The linkage allows the mattress frame to be in motion relative to the stationary bed frame, thereby allowing the bed to be rocked. Electric motors have been added to the rocking beds to ensure that the beds will stay in motion for the duration of the sleep period. The linkages may also be adjusted to vary the displacement or amount of rocking motion from a very few degrees of motion that results in a small rocking motion to several degrees that creates a large rocking motion.

While the displacement of the rocking motion may be changed, often times an individual may want to adjust the actual shape of the rocking motion. An individual may tire of being rocked like he was on a boat at sea and may seek a change in the shape of the motion or an individual may purchase a rocking bed thinking that he was seeking the rocking motion of a boat at sea. He may determine only after several nights of use that he desires to be rocked in an entirely different manner, such as like he was asleep on a glider or in a hammock, and in a manner that cannot be met by simply changing the displacement of rocking.

Therefore, a need exists for a rocking style bed that not only allows the individual or couple to vary the displacement of the rocking motion, but also allows the individual or couple to vary the shape of the rocking motion so that the maximum benefits of a good nights sleep may be realized and the individual or couple may wake the next morning completely refreshed and recharged. Furthermore, the benefits of changing the actual rocking shape of the bed may also be realized by those who are bed ridden by helping to alleviate pressure points, improve circulation, and aiding in a faster recovery time.

BRIEF SUMMARY OF THE INVENTION

In accordance with the present invention, a variable motion rocking bed is provided that includes a first support structure including a first threaded rod having a first section threaded in a first direction and a second section threaded in a second direction, a second support structure including a second threaded rod having a first section threaded in a first direction and a second section threaded in a second direction, and a frame, the frame capable of being in a rocking motion with respect to the first support structure and the second support structure. The rocking bed further includes a first pair of linkage assemblies secured between the first support structure and the frame, and a second pair of linkage assemblies secured between the second support structure and the frame. The position of the first pair of linkage assemblies may be adjusted with respect to the first support structure and the position of the second pair of linkage assemblies may be adjusted with respect to the second support structure to change the shape of the rocking motion of the frame relative to the first support structure and the second support structure.

BRIEF DESCRIPTION OF THE SEVERAL VIEWS OF THE DRAWINGS

The features and inventive aspects of the present invention will become more apparent from the following detailed description, claims, and drawings, of which the following is a brief description:

DETAILED DESCRIPTION OF THE INVENTION

Figure 1:
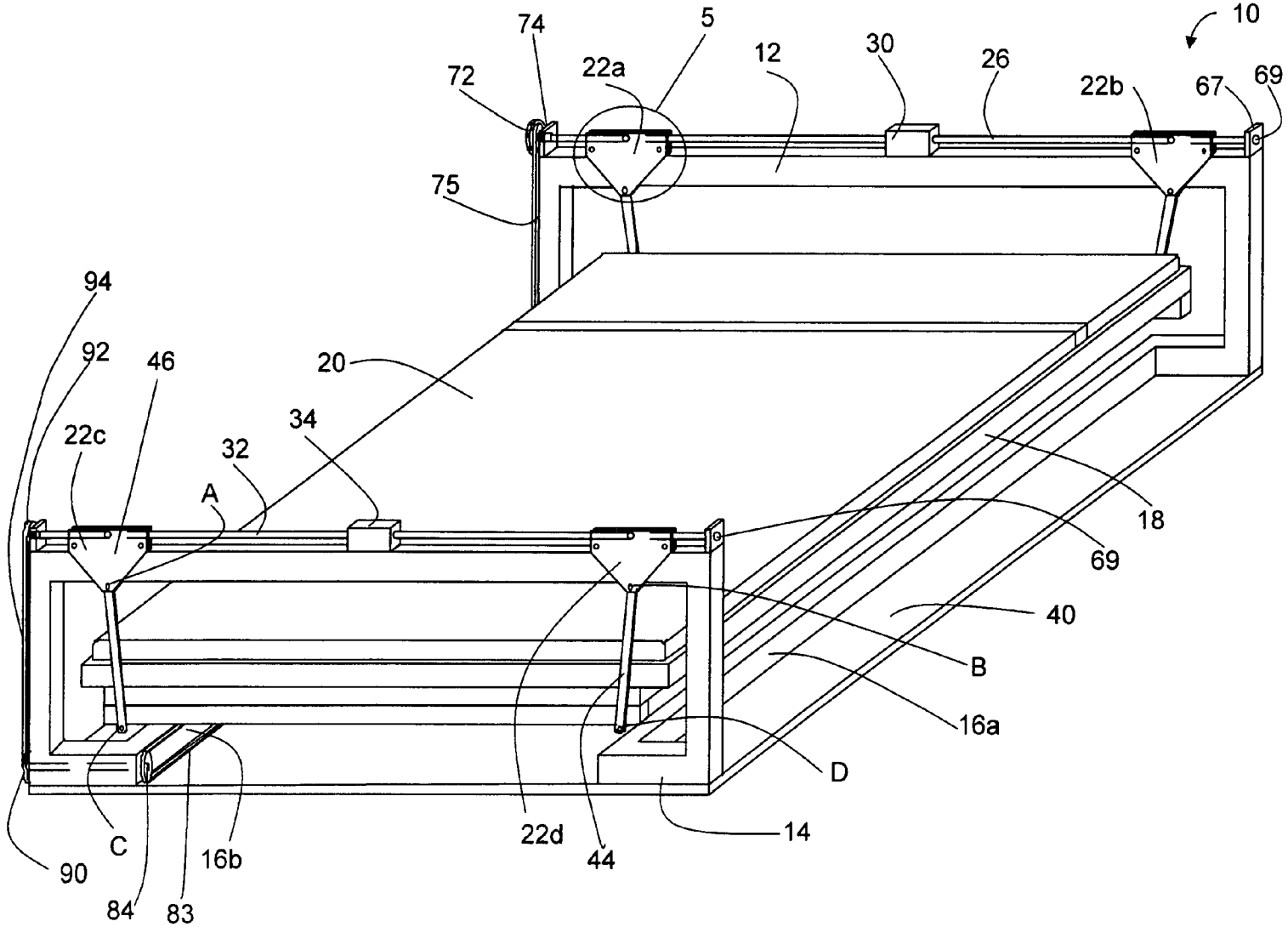
FIG. 1 is a perspective view of a variable motion rocking bed according to an embodiment of the present invention.

Referring now to the drawings, a preferred illustrative embodiment of the present invention is shown in detail. Although the drawings represent an embodiment of the present invention, the drawings are not necessarily to scale and certain features may be exaggerated to better illustrate and explain the present invention. Further, the embodiment set forth herein is not intended to be exhaustive or otherwise to limit or restrict the invention to the precise forms and configurations shown in the drawings and disclosed in the following detailed description.

Figure 2:
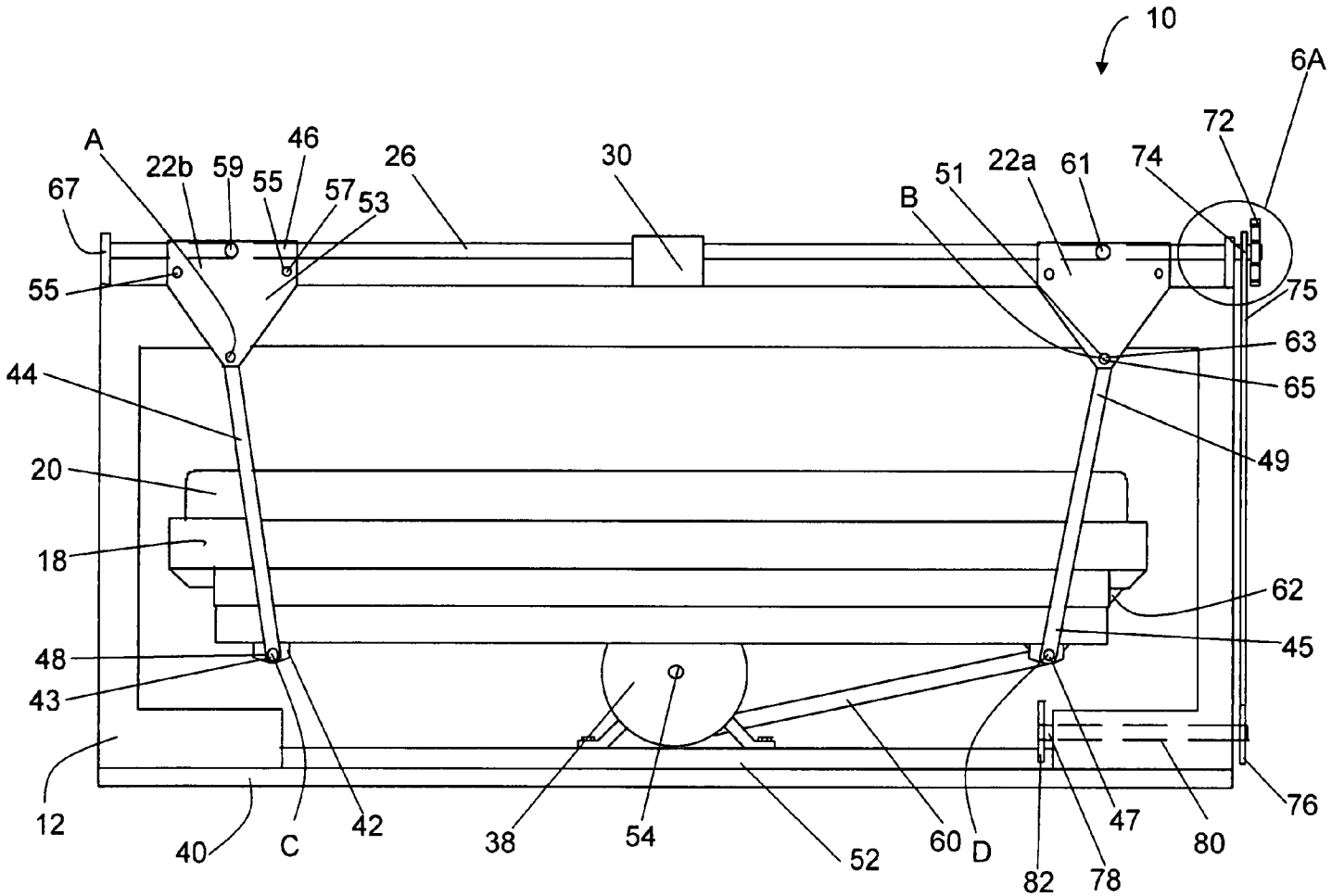
FIG. 2 is a front view of the variable motion rocking bed according to an embodiment of the present invention.
Figure 3:
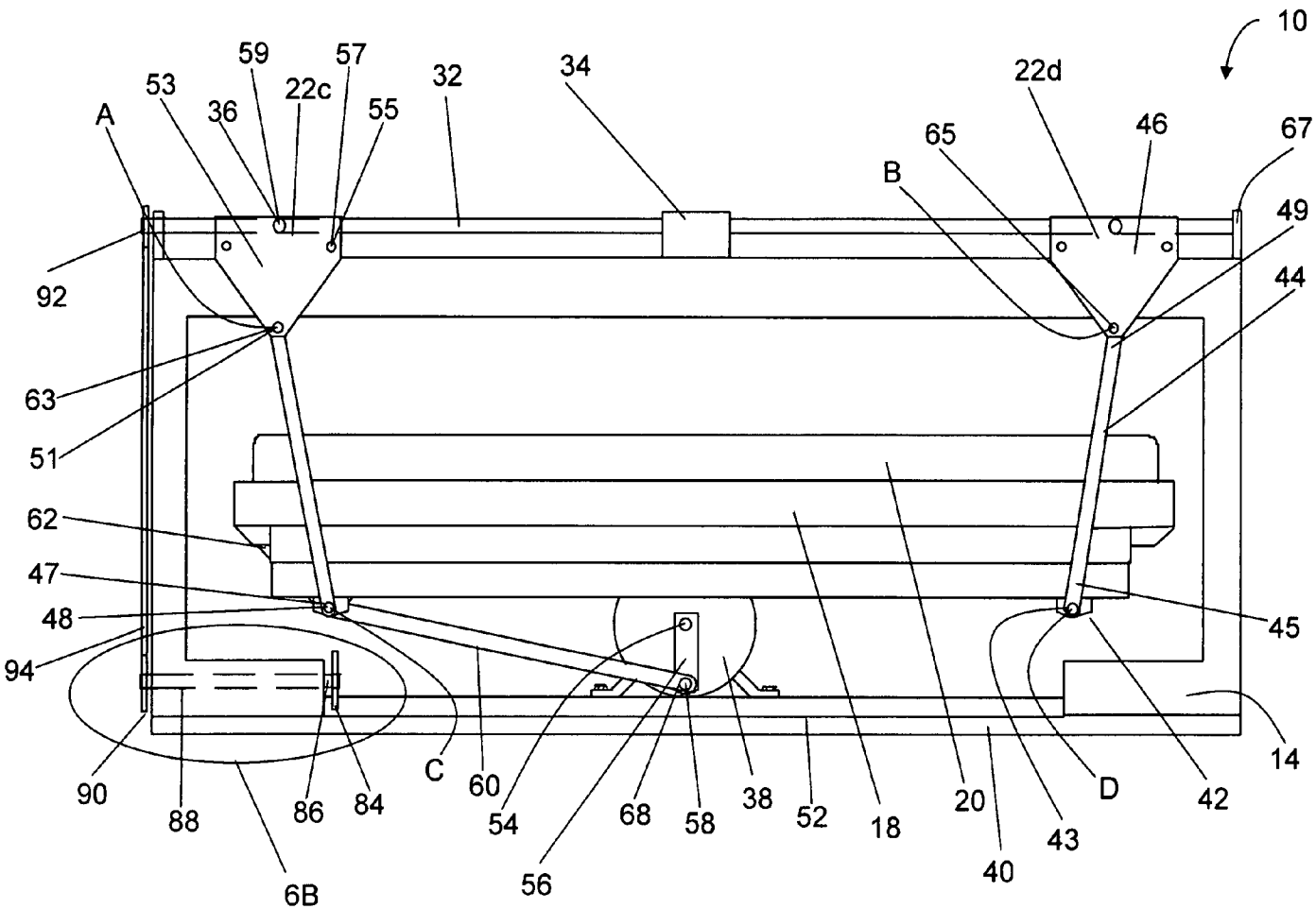
FIG. 3 is a rear view of the variable motion rocking bed according to an embodiment of the present invention.

A variable motion rocking bed 10 is illustrated in FIGS. 1-3 having a first support structure 12, a second support structure 14, and side rails 16*a* and 16*b* according to an embodiment of the present invention. In this particular embodiment, first support structure 12 is a headboard and second support structure 14 is a footboard. However, first and second support structures are not limited to headboard and footboard and may be any type of structures that support rocking bed 10, such as walls or portions of a ceiling.

Each of side rails 16*a* and 16*b* extend from headboard 12, generally parallel to one another, to footboard 14. Side rails 16*a* and 16*b* are spaced apart a distance such that a generally rectangular shape is formed by headboard 12, side rails 16*a* and 16*b*, and footboard 14. Rocking bed 10 further includes a base 40 that extends to the outer edges of headboard 12, footboard 14 and each of side rails 16*a* and 16*b* for support of each of the above components. Alternatively, rocking bed 10 may be supported by legs (not shown) that extend downward from each of four corners of rocking bed 10 that have been created by the intersection of side rails 16*a* and 16*b* with headboard 12 and footboard 14.

Further included in rocking bed 10 is a mattress frame 18 that may be secured to rocking bed 10 by four linkage assemblies 22*a*, 22*b*, 22*c*, and 22*d*. Each of the four linkage assemblies consists of a bearing block 42, a pivot linkage 44, and a slide assembly 46. Bearing blocks 42 each include a hole 43 and bearing blocks 42 may be positioned and secured (by welding, with the use of fasteners, or any other means of securement) at each of four corners of mattress frame 18. Pivot linkages 44 each have a first end 45 that include a first hole 47 and a second end 49 that include a second hole 51. First hole 47 of pivot linkages 44 may be aligned with hole 43 of each bearing block 42. A pin 48 may be introduced into each of holes 43 and 47 to secure pivot linkages 44 to bearing blocks 42 and frame 18. It should be noted that any other fastening means may be employed to secure pivot linkages 46 to bearing blocks 42 as long as the fastening means allows pivot linkages 44 to rotate freely about bearing blocks 42.

Figure 5:
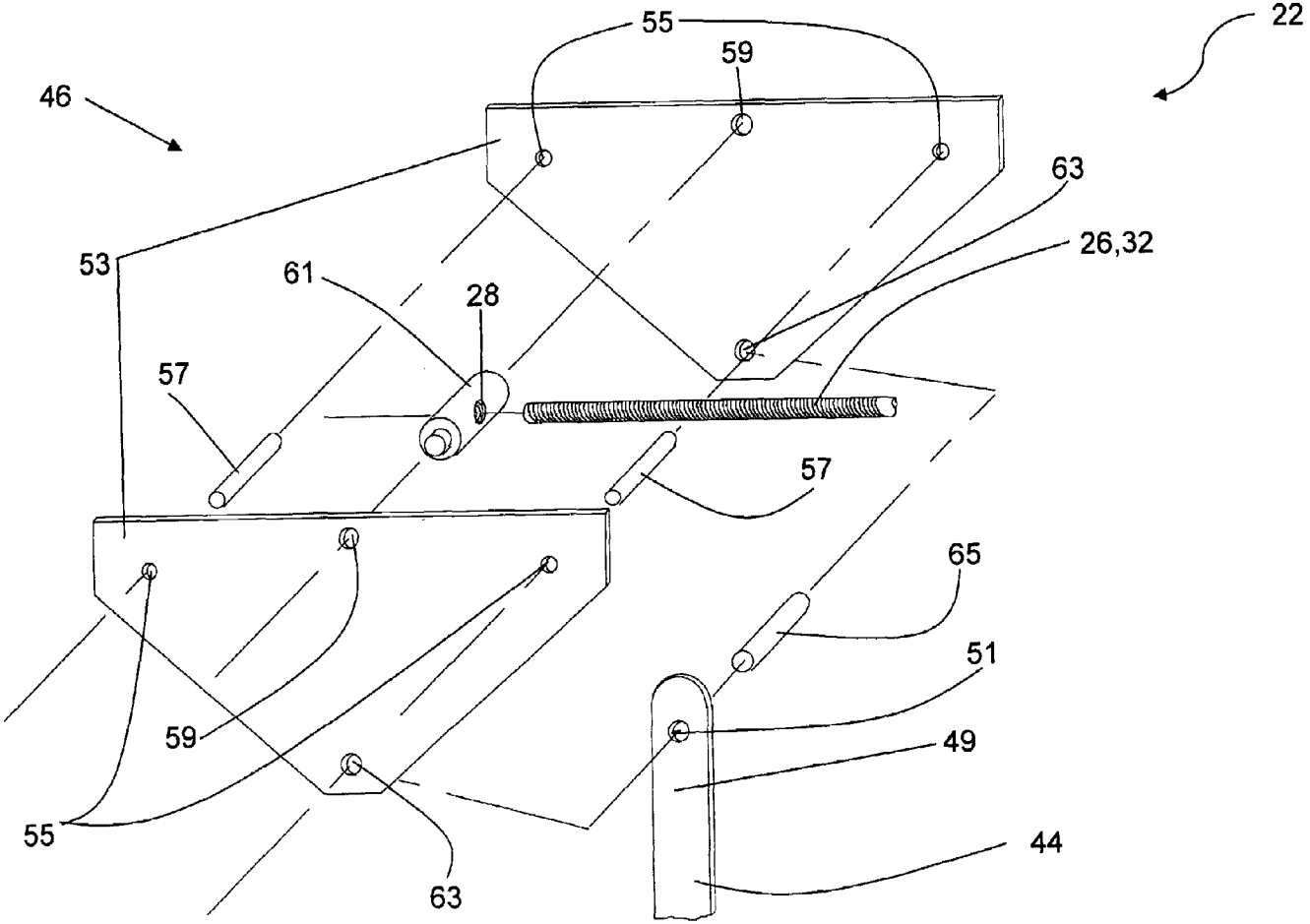
FIG. 5 is an exploded view of a slide assembly of FIG. 1 according to an embodiment of the present invention.

As illustrated in FIGS. 1-3, slide assemblies 46 may be positioned at each of the four corners of rocking bed 10. As further shown in FIG. 5, Slide assemblies 46 include two plates 53 of similar size and shape that each include a pair of holes 55 near a top edge for accepting fasteners 57, such as pins or a bolt and nut assembly, to secure plates 53 to one another. Plates 53 are secured together such that the distance between the inner surfaces of plates 53 is slightly larger than the thickness of headboard 12 and footboard 14. Plates 53 are spaced and secured to one another in this manner so that slide assemblies 46 may freely travel a horizontal distance along the top edges of headboard 12 and footboard 14 when secured to variable motion rocking bed 10.

Plates 53 further include a third hole 59 near the top edge of plates 53 for accepting and securing a shaft 61. Shaft 61 includes a threaded hole 28 for accepting threaded rods 26 and 32 (described in further detail below). Plates 53 also include a fourth hole 63. Fourth hole 63 of each slide assembly 46 may be aligned with second hole 51 of each pivot linkage 44. A pin 65 may be introduced into each of holes 63 and 51 to secure pivot linkages 44 to slide assemblies 46 and rocking bed 10. In this manner, bed 10 is now secured to frame 18. It should be noted that any other fastening means may be employed to secure pivot linkages 44 to slide assemblies 46 as long as the fastening means allows pivot linkages 44 to rotate freely about slide assemblies 46.

Linkages 22*a*, 22*b*, 22*c* and 22*d* not only secure frame 18 to headboard 12 and footboard 14, they also allow frame 18 the freedom to move laterally relative to headboard 12 and footboard 14 such that a rocking motion may be created. Plates 53, pivot linkages 44, bearing blocks 42, frame 18, and associated fasteners may be manufactured of any metallic, composite, or other material that allows slide assemblies 46 and pivot linkages 44 as well as bearing blocks 42 and pivot linkages 44 to rotate freely with respect to one another while maintaining a secure and supportive rocking structure. Mattress frame 18 may be structured in a manner such that a typical mattress 20 may be fully supported during any rocking motion.

Slide assemblies 46 of linkages 22*a* and 22*b* may be secured to headboard 12 (see FIGS. 1 and 2) and slide assemblies 46 of linkages 22*c* and 22*d* may be secured to footboard 14 (see FIGS. 1 and 3). As stated above, linkages 22*a*-22*d* may be secured to headboard 12 and footboard 14, respectively, in such a manner that allows slide assemblies 46 to freely travel a horizontal distance along the width of headboard 12 and footboard 14. In this particular embodiment of the present invention, threaded rod 26 extends the width of each of headboard 12 and footboard 14. As stated above, slide assemblies 46 each include shaft 61 having threaded hole 28 that is sized to accept and allow the threads of rod 26 to travel through the threads of hole 28 as rod 26 is rotated. A centering block 30 is positioned at the centerline and secured to headboard 12. Centering block 30 includes a shaft that allows rod 26 to pass through and rotate freely, while generally limiting the movement of rod 26 in the axial direction. Rod 26 may be threaded in the opposite direction from centering block 30 outward toward the outer edges of headboard 12. The rod threading is done in this manner such that when rod 26 is rotated in a first direction, slide assemblies 46 move inward toward the centerline of headboard 14 thereby allowing linkages 22*a* and 22*b* to be selectively positioned on headboard 12. When rod 26 is rotated in the opposite direction, slide assemblies 46 move outwardly together away from the centerline of headboard 12.

Footboard 14 is configured in much the same manner as headboard 12. Footboard 14 includes a threaded rod 32 and centering block 34 as well. Slide assemblies 46 of linkages 22*c* and 22*d* also each include shaft 61 having threaded hole 28 that is sized to accept and allow the threads of rod 32 to travel through the threads of hole 28 as rod 32 is rotated. Slide assemblies 46 may be made to move inwardly toward one another if rod 32 is rotated in a first direction or outward away from each other if rod 32 is rotated in an opposite direction, thereby allowing the selective positioning of linkages 22*c* and 22*d*.

Further included at the outer edges of both headboard 12 and footboard 14 are support bearing blocks 67. Bearing blocks 67 each include a hole 69 for accepting an end of either threaded rod 26 of headboard 12 or threaded rod 32 of footboard 14. Bearing blocks 67 are positioned at the ends of headboard 12 and footboard 14 to support rods 26 and 32 and to aid in ensuring slide assemblies 46 remain captured to rocking bed 10.

Figure 4:
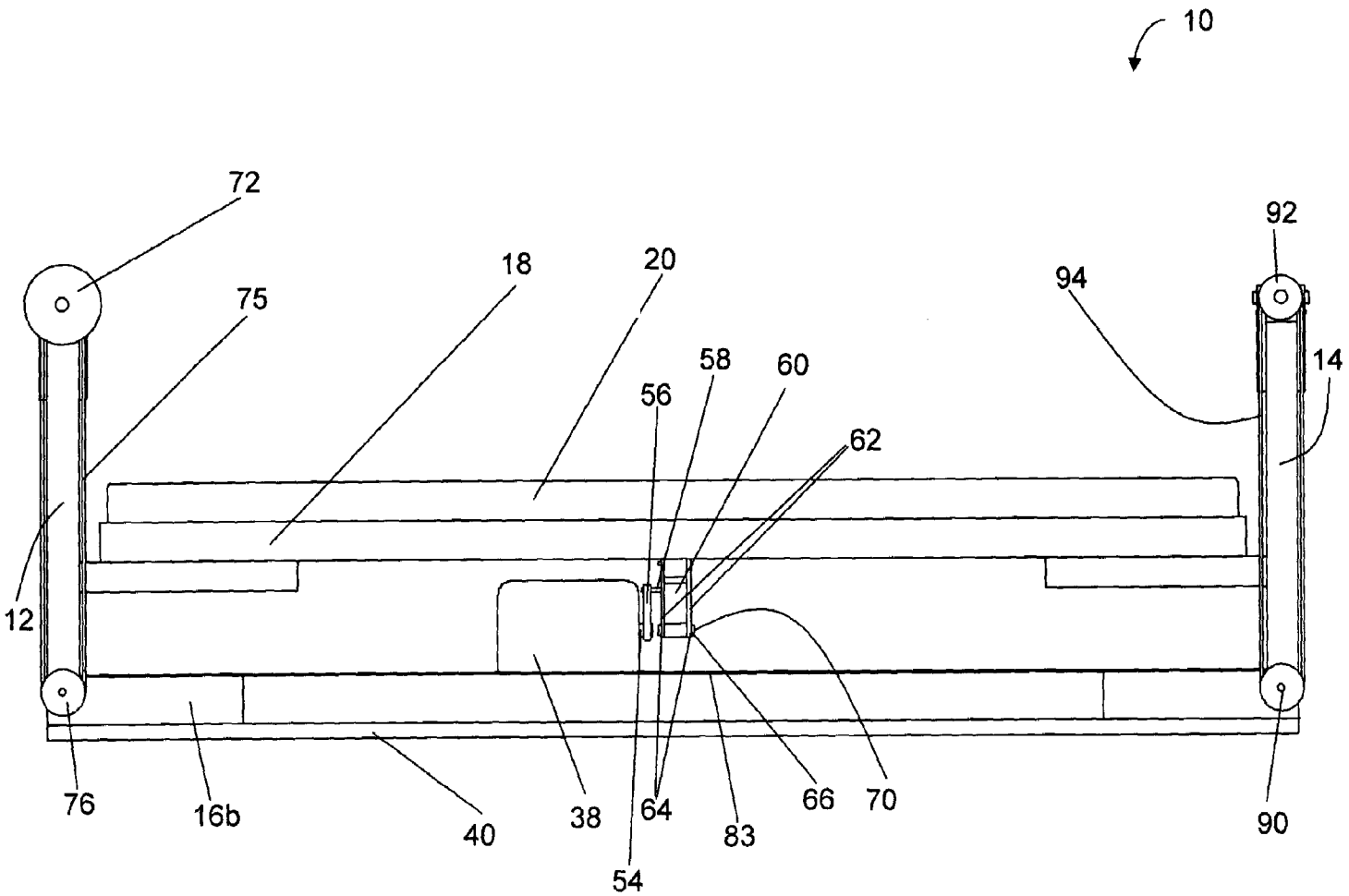
FIG. 4 is a side view of the variable motion rocking bed according to an embodiment of the present invention.

Referring now to FIGS. 2-4, rocking bed 10 also includes a motor 38 that may be connected to mattress frame 18 in such a manner that allows frame 18 to be in a constant rocking motion relative to bed 10. Typically, motor 38 may be secured to a support frame 52 that is secured to base 40 and generally centered between side rails 16*a* and 16*b* and headboard 12 and footboard 14. Although motor 38 is described in this particular embodiment of the present invention as being generally centered with respect to rocking bed 10, it must be noted that motor 38 may be positioned in any location that will induce a rocking motion in frame 18 relative to the remainder of rocking bed 10.

Motor 38 may be any typical electric motor that is configured to freely rotate a shaft 54 or axle. A drive crank 56 having a crank pin 58 may be secured to shaft 54. Crank pin 58 may be offset a distance along crank drive 56 from shaft 54 such that when shaft 54 is being rotated by motor 38, crank pin 58 may be rotating a radial distance from shaft 54 to create a circular motion. Crank pin 58 may be secured to frame 18 by a drive linkage 60. Frame 18 includes a pair of drive plates 62 that extend from the bottom of frame 18. Drive plates 62 each include a hole 64 and are secured to frame 18 in such a manner that plates 62 are generally parallel to one another and each of holes 64 are aligned. Drive linkage 60 may be positioned such that it extends between motor 38 and plates 62. Drive linkage 60 includes a first hole 66 that aligns with holes 64 in plates 62 and a second hole 68 that is sized to accept crank pin 58. Holes 64 and 66 are sized to accept a pin 70 such that plates may be secured to linkage 60, yet allows linkage 60 to rotate freely about plates 62. Second hole 68 is sized to accept and secure crank pin 58 to linkage 60 and to allow crank pin 58 to rotate freely within second hole 68. When motor 38 is energized and shaft 54 is allowed to rotate freely, shaft 54 rotates drive crank 56 in a manner that displaces crank pin 58, drive linkage 60 and frame 18, thereby creating a motion in frame 18 relative to variable motion rocking bed 10.

Figure 6A:
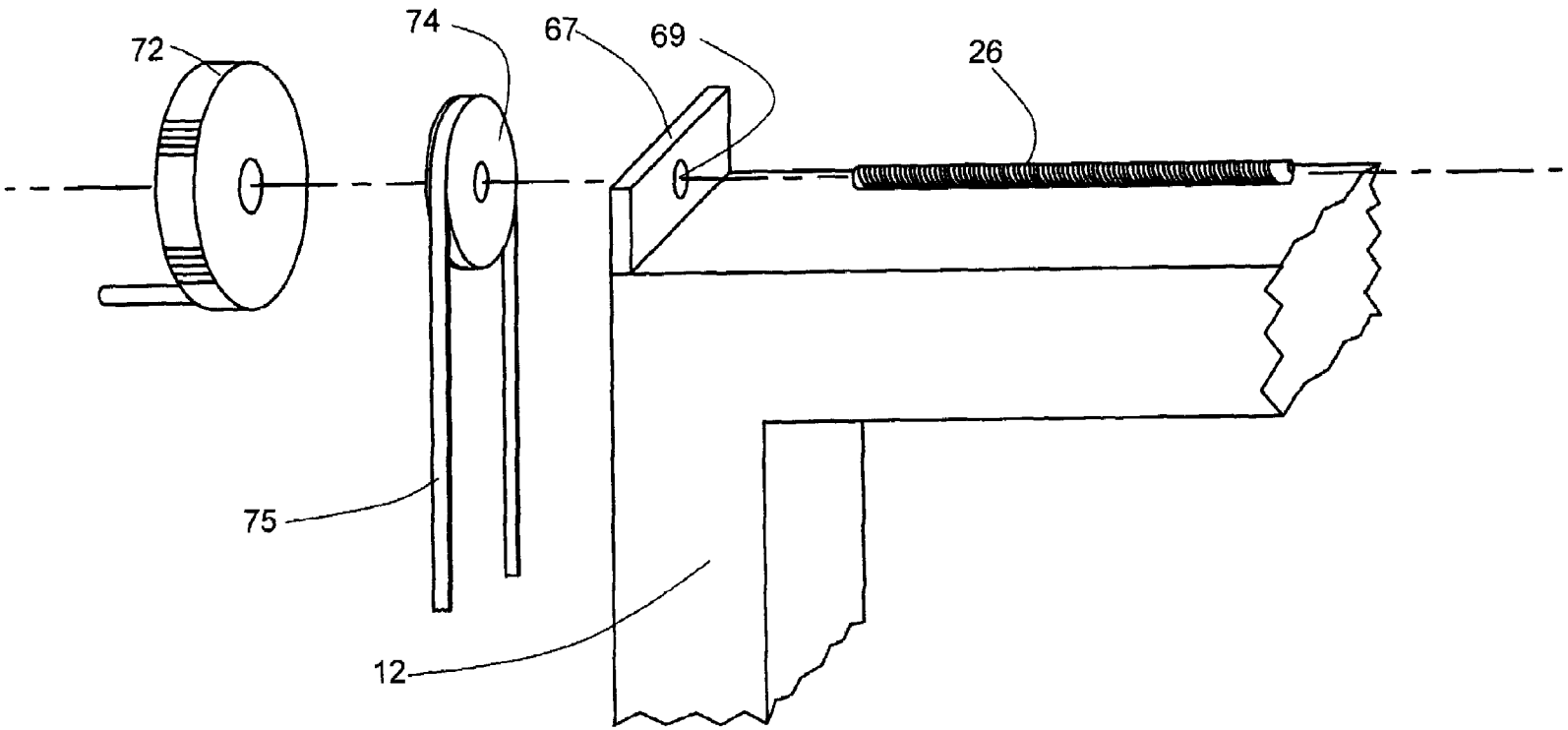
FIG. 6A is an exploded view of a pulley and hand wheel assembly of FIG. 2 according to an embodiment of the present invention.

As illustrated in FIGS. 1, 2, 4 and 6A, rocking bed 10 further includes a hand wheel 72 that is secured to an end of threaded rod 26 and positioned at one of the outer edges of headboard 12 such that it may be accessed easily by an individual. Hand wheel 72 may be rotated by any person. The rotating of hand wheel 72 also rotates rod 26 such that slide assemblies may be moved inward and outward about footboard 12 as described above. Also secured to rod 26 in the general vicinity of hand wheel 72 is a timing pulley 74 that rotates with rod 26 as hand wheel 72 is rotated by an individual. FIG. 6A illustrates the assembly of hand wheel 72 (shown with a crank for easier manipulation of hand wheel 72), timing pulley 74, rod 26 and headboard 12. Included on bed 10 near a bottom edge of headboard 12 is an outer pulley 76 that is secured to a pulley shaft 78 (see e.g. FIG. 6B). Pulley shaft 78 extends through and is allowed to rotate freely in a cylinder 80 positioned in a lower portion of headboard 12. Secured to an opposite end of pulley shaft 78 is an inside pulley 82. Outer pulley 76, pulley shaft 78 and inside pulley 82 are secured in such a manner that as outer pulley is rotated, inside pulley 82 is rotated in the same manner and at the same time.

Figure 6B:
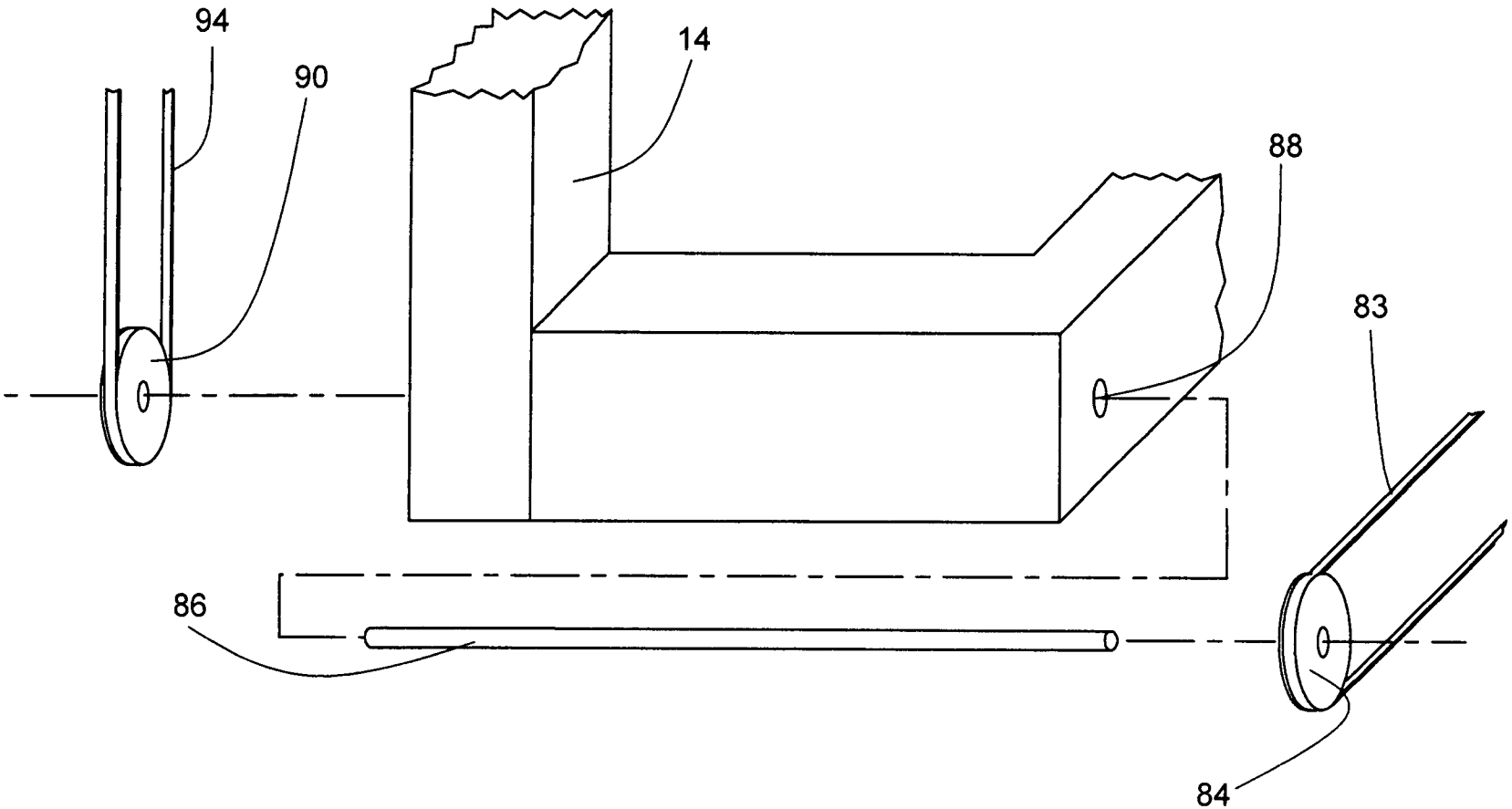
FIG. 6B is an exploded view of a pulley assembly of FIG. 3 according to an embodiment of the present invention.

Timing pulley 74 and outer pulley 76 are aligned in such a manner that a belt 75, chain, or the like may be extended between timing pulley 74 and outer pulley 76 so that the rotation of timing pulley 74 induces movement in belt 75 that in turn rotates outer pulley 76, pulley shaft 78, and inside pulley 82. A similar pulley system is included in footboard 14 and is illustrated in FIG. 6B. A second inside pulley 84 is secured to a second pulley shaft 86 that extends through and is allowed to rotate freely in a cylinder 88 positioned in a lower portion of footboard 14. Secured to an opposite end of pulley shaft 86 is a second outer pulley 90. As described above, outer pulley 90, pulley shaft 86 and inside pulley 84 are secured in such a manner that as outer pulley 90 is rotated, inside pulley 84 is rotated in the same manner and at the same time. Inside pulley 82 is aligned with inside pulley 84 in such a manner that a second belt 83, chain, or the like may be extended between inside pulley 82 and inside pulley 84 so that the rotation of inside pulley 82 induces movement in belt 83 that in turn rotates inside pulley 84, pulley shaft 86, and outer pulley 90.

Secured to threaded rod 32 of footboard 14 is a second timing pulley 92. Timing pulley 92 and outer pulley 90 are aligned in a manner that a third belt 94, chain, or the like may be extended between outer pulley 90 and timing pulley 92 so that the rotation of outer pulley 90 induces movement in belt 94 that in turn rotates timing pulley 92 and threaded rod 32. The rotation of rod 32 through threaded shafts 61 of slide assemblies 46 induces the movement in linkages 22*c* and 22*d* about the width of footboard 14.

Figure 7A:
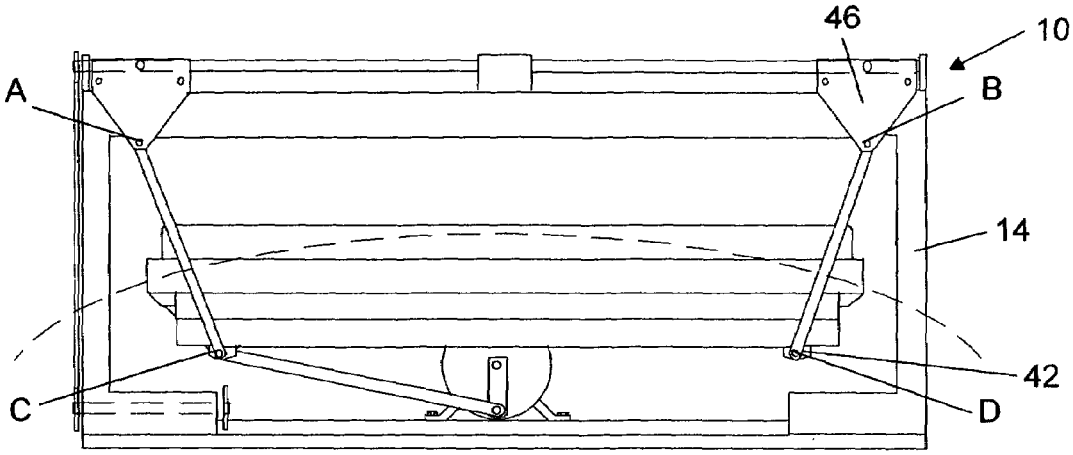
FIGS. 7A-7C are rear views of the variable motion rocking bed according to an embodiment of the present invention illustrating the linkages in a position that results in a rocking motion that mimics a boat rocking at sea, a glider, and a hammock, respectively.

As described above, slide assemblies 46 of linkages 22*a*-22*d* may be positioned in a number of different positions along headboard 12 and foothoard 14 to vary the displacement and the actual shape of the arc that frame 18 of rocking bed 10 will travel through. By rotating hand wheel 72 in a first direction, slide assemblies 46 may be positioned at the outer most edges of headboard 12 and foot board 14. To aid the discussion of the motion of frame 18 with respect to headboard 12 and footboard 14, each of the pivot points of linkages 22*a*-22*d* are labeled A, B, C, and D as shown in FIGS. 2 and 3 depending on whether one is standing at headboard 12 (FIG. 2) or footboard 14 (FIG. 3). Standing at footboard 14 looking at variable motion rocking bed 10, slide assemblies 46 will be positioned to the outside of bearing blocks 42. Pivot linkages 44 will form an outer angle between slide assemblies 46 and bearing blocks 42 as illustrated in FIG. 7A. The distance between A and B will be greater than the distance between C and D. When motor 38 is energized, drive crank 56 will rotate drive linkage 60 about shaft 54, thereby forcing plates 62 and frame 18 into motion. Frame 18 will rotate about pins 48 at bearing blocks 42. Pivot linkages will rotate about pins 48 at bearing blocks 42 and pins 65 at slide linkages 46. Frame 18 will be in a rocking motion relative to bed 10. With slide assemblies 46 positioned in this manner, the leading edge of frame 18 will drop as the trailing edge of frame 18 rises. When the direction of the frame reverses, the new leading edge of frame 18 will drop as the new trailing edge of frame 18 rises. The path of a complete cycle as viewed from headboard 12 or footboard 14 will resemble that of a sad face. This type of rocking motion will most represent that of a boat rocking through the waves at sea.

Figure 7B:
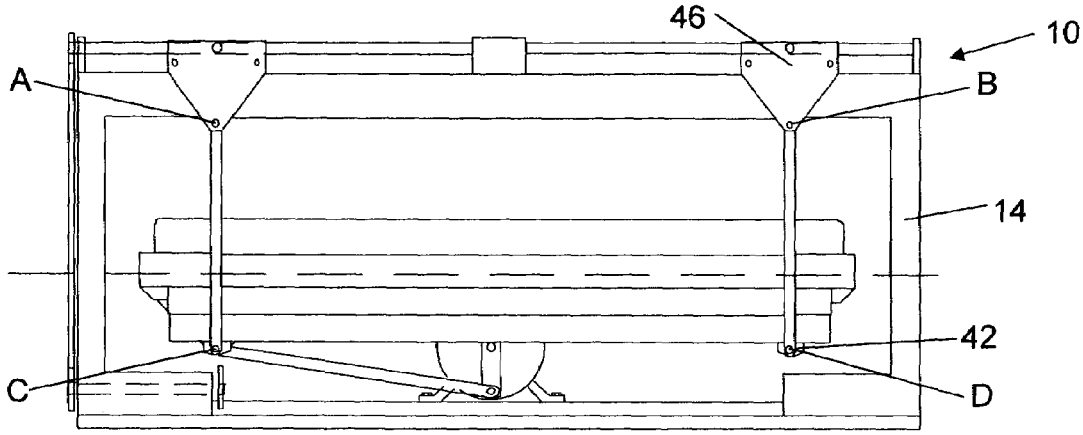

Hand wheel may be rotated in a second direction such that the displacement of the rocking motion may be lessened and adjusted to suit the desires of the individual. Hand wheel may be rotated further in a second direction such that slide assemblies 46 position pivot linkages 44 in a completely vertical position when frame 18 is at rest or in a center position relative to headboard 12 and footboard 14 as illustrated in FIG. 7B. The distance between A and B will equal the distance between C and D. In this manner, when motor 38 is energized, drive crank 56 will rotate drive linkage 60 about shaft 54, thereby forcing plates 62 and frame 18 into motion. Frame 18 will rotate about pins 48 at bearing blocks 42. Pivot linkages will rotate about pins 48 at bearing blocks 42 and pins 65 at slide linkages 46. Frame 18 will be in a rocking motion relative to rocking bed 10. With slide assemblies 46 positioned in this manner, the leading and trailing edges of frame 18 will remain generally on the same plane and frame 18 will glide gently back and forth about rocking bed 10 in a generally flat manner. This type of rocking motion will most represent that of a glider swaying back and forth in a generally flat motion.

Figure 7C:
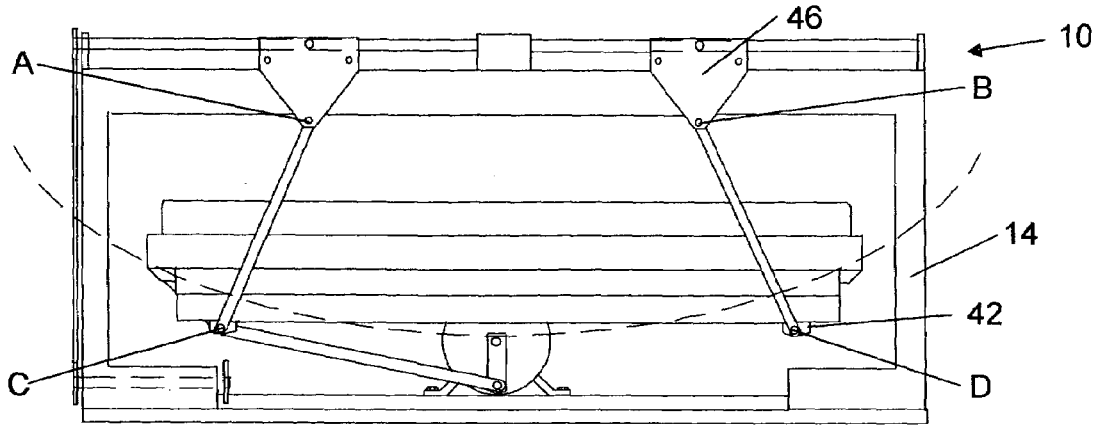

By rotating hand wheel 72 still further in the second direction, slide assemblies 46 may be positioned such that they are close to the center line of bed 10 or to the inside of bearing blocks 42. Pivot linkages 44 will form an inner angle between slide assemblies 46 and bearing blocks 42 when frame 18 is at rest or in a center position relative to headboard 12 and footboard 14 as illustrated in FIG. 7C. The distance between A and B is less than the distance between C and D. When motor 38 is energized, drive crank 56 will rotate drive linkage 60 about shaft 54, thereby forcing plates 62 and frame 18 into motion. Frame 18 will rotate about pins 48 at bearing blocks 42. Pivot linkages will rotate about pins 48 at bearing blocks 42 and pins 65 at slide linkages 46. Frame 18 will be in a rocking motion relative to bed 10. With slide assemblies 46 positioned in this manner, the leading edge of frame 18 will rise as the trailing edge of frame 18 falls. When the direction of frame 18 reverses, the new leading edge of frame 18 will rise as the trailing edge of frame 18 falls. The path of a complete cycle as viewed from either headboard 12 or footboard 14 will resemble that of a smile. This type of rocking motion will most represent that of a hammock swinging from two fixed points.

Footboard 14 may include a second hand wheel (not shown) to allow linkages 22*a* and 22*b* to be positioned separately and differently from linkages 22*c* and 22*d*. In this particular embodiment of the present invention, second belt 83 may be removed from rocking bed 10, thereby allowing linkages 22*a* and 22*b* to be independently adjusted with respect to linkages 22*c* and 22*d*.

Rather than a hand wheel, a second motor may be positioned and secured to rocking bed 10 and used to rotate rods 26 and 32. Both motor 38 and the second motor may be wired or linked by radio frequency to a remote control. This will enable the individual to start or stop the rocking motion of frame 18 with respect to bed 10 and allow the individual to change the shape of the motion, by repositioning slide assemblies 46 without having to leave the comfort of his bed.

Through the rotations of the rods and the belt and pulley system, an individual may position linkages 22*a*-22*d* in such a manner that will allow the individual to change both the displacement as well as the shape of the rocking motion. The displacement of the rocking motion may also be varied by changing the radial distance between crank pin 58 and shaft 54 to provide the individual with even further adjustment choices. The individual will have the ability to modify rocking bed 10 and help him to quickly develop a personalized rocking motion that will provide him with all the benefits of a restful sleep that he may have lacked in the past from an ordinary bed. Also, a variable speed motor may be employed to allow for an adjustment of the speed of the rocking motion. The individual user may adjust the speed slower or faster depending on their wants and desires thereby providing the individual with still further adjustment features to maximize comfort.

The present invention has been particularly shown and described with reference to the foregoing embodiment, which is merely illustrative of the best modes presently known for carrying out the invention. It should be understood by those skilled in the art that various alternatives to the embodiment of the invention described herein may be employed in practicing the invention without departing from the spirit and scope of the invention as defined in the following claims. It is intended that the following claims define the scope of the invention and that the method within the scope of these claims and their equivalents be covered thereby. This description of the invention should be understood to include all novel and non-obvious combination of elements described herein, and claims may be presented in this or a later application to any novel non-obvious combination of these elements. Moreover, the foregoing embodiment is illustrative, and no single feature or element is essential to all possible combinations that may be claimed in this or a later application.

What is claimed is:

1. A variable motion rocking bed comprising:

a first support structure, said first support structure including a first threaded rod having a first section threaded in a first direction and a second section threaded in a second direction;

a second support structure, said second support structure including a second threaded rod having a first section threaded in a first direction and a second section threaded in a second direction;

a frame, said frame capable of being in a rocking motion with respect to said first support structure and said second support structure;

a first pair of linkage assemblies secured to said first support structure and said frame;

a second pair of linkage assemblies secured to said second support structure and said frame; and wherein the position of said first pair of linkage assemblies is adjusted with respect to said first support structure and the position of said second pair of linkage assemblies is adjusted with respect to said second support structure to change the shape of the rocking motion of said frame relative to said first support structure and said second support structure.

2. The rocking bed as recited in claim 1, further including a pair of side rails extending parallel to each other between said first support structure and said second support structure such that a generally rectangular shape is created by said side rails, said first support structure, and said second support structure.

3. The rocking bed as recited in claim 1, wherein said first support structure is a headboard and said second support structure is a footboard.

4. The rocking bed as recited in claim 1, further including a drive linkage having a first end secured to a motor and a second end secured to said frame.

5. The rocking bed as recited in claim 1, wherein each of said first and each of said second pairs of linkage assemblies include a first plate and a second plate.

6. The rocking bed as recited in claim 5, wherein each of said first and each of said second pairs of linkage assemblies include a pivot linkage having a first end of said pivot linkage secured to said frame and a second end secured to said first plate and said second plate.

7. The rocking bed as recited in claim 1, wherein said first threaded rod extends the width of said first support structure and wherein said second threaded rod extends the width of said second support structure.

8. The rocking bed as recited in claim 1, wherein each of said first pair of linkage assemblies include a shaft having a threaded hole to accept said first threaded rod and each of said second pair of linkage assemblies include a shaft having a threaded hole to accept said second threaded rod.

9. The rocking bed as recited in claim 8, further including a first pulley attached to said first threaded rod and a second pulley attached to said second threaded rod.

10. The rocking bed as recited in claim 9, wherein said first support structure includes a first shaft having an inner pulley and outer pulley and said second support structure includes a second shaft having an inner pulley and an outer pulley.

11. The rocking bed as recited in claim 10, further including a first belt connected to said first pulley and said outer pulley of said first shaft, a second belt connected to said inner pulley of said first shaft and said inner pulley of said second shaft, and a third belt connected between said outer pulley of said second shaft and said second pulley.

12. The rocking bed as recited in claim 11, further including a rotatable dial secured to said first pulley, said dial used to rotate said first pulley and said first threaded rod in a first and second direction.

13. The rocking bed as recited in claim 11, further including a second motor secured to said first pulley, said second motor used to rotate said first pulley and said first threaded rod in a first and a second direction.

14. The rocking bed as recited in claim 1, wherein positioning the first pair and second pair of linkage assemblies such that the rocking motion of the frame relative to the first support structure and the second support structure of the bed mimics the rocking motion of a boat rolling through the waves at sea with the leading edge of the frame falling and the trailing edge of the frame rising relative to the bed.

15. The rocking bed as recited in claim 1, wherein positioning the first pair and second pair of linkage assemblies such that the rocking motion of the frame relative to the first support structure and the second support structure of the bed mimics the rocking motion of a glider with the frame rocking in a generally flat plane relative to the bed.

16. The rocking bed as recited in claim 1, wherein positioning the first pair and second pair of linkage assemblies such that the rocking motion of the frame relative to the first support structure and the second support structure of the bed mimics the rocking motion of a hammock with the leading edge of the frame rising and the trailing edge of the frame falling relative to the bed.

17. A method for varying the shape of the rocking motion of a mattress frame of a variable motion rocking bed comprising the steps of:

positioning a first pair of linkage assemblies secured between a headboard of the bed and a mattress frame about the width of the headboard; and positioning a second pair of linkage assemblies secured between a footboard of the bed and the mattress frame about the width of the footboard;

slidably adjusting the position of the first pair of linkage assemblies along the width of the headboard and the second pair of linkage assemblies along the width of the footboard such that the shape of the rocking motion of the mattress frame relative to the headboard and footboard of the bed may be varied.

18. The method as recited in claim 17, further comprising the steps of:

positioning the first pair and second pair of linkage assemblies such that the rocking motion of the mattress frame relative to the headboard and the footboard of the bed mimics the rocking motion of a boat rolling trough the waves at sea with the leading edge of the mattress frame falling and the trailing edge of the mattress frame rising relative to the headboard and footboard of the bed.

19. The method as recited in claim 17, further comprising the steps of:

positioning the first pair and second pair of linkage assemblies such that the rocking motion of the mattress frame relative to the headboard and the footboard of the bed mimics the rocking motion of a glider with the mattress frame rocking in a generally flat plane relative to the headboard and footboard of the bed.

20. The method of claim 17, further comprising the steps of:

positioning the first pair and second pair of linkage assemblies such that the rocking motion of the mattress frame relative to the headboard and the footboard of the bed mimics the rocking motion of a hammock with the leading edge of the mattress frame rising and the trailing edge of the mattress frame falling relative to the headboard and footboard of the bed.

* * * * *